US006099372A

United States Patent [19]

Toyama

[11] Patent Number: 6,099,372

[45] Date of Patent: Aug. 8, 2000

[54] INTAKE APPARATUS OF OUTBOARD MOTOR

[75] Inventor: Takeshi Toyama, Hamamatsu, Japan

[73] Assignee: Suzuki Kabushiki Kaisha, Hamamatsu, Japan

[21] Appl. No.: 09/333,667

[22] Filed: Jun. 16, 1999

[30] Foreign Application Priority Data

Jun. 17, 1998 [JP] Japan ..... P.10-169886

[51] Int. Cl.[7] ..... B63H 20/32

[52] U.S. Cl. ..... 440/77; 123/195 C; 440/900

[58] Field of Search ..... 440/53, 88, 900, 440/76, 77; 123/195 C, 195 P

[56] References Cited

U.S. PATENT DOCUMENTS 4,734,070 3/1988 Mondek ..... 440/88

5,683,277 11/1997 Tsunoda et al. ..... 440/88

*Primary Examiner*—Ed Swinehart

*Attorney, Agent, or Firm*—Oblon, Spivak, McClelland, Maier & Neustadt, P.C.

[57] ABSTRACT

An outboard motor includes an engine unit in which a crank shaft in a manner that the upper end, in a state of the outboard motor to a hull, projects outside the engine unit and a rotational member such as flywheel magneto device is covered by an engine cover, and the engine unit is covered by an outboard motor cover to which an atmospheric air intake port is formed. The engine cover is composed of inner and outer wall sections between which a closed inner space is defined, the engine cover is connected to a silencer so that the closed inner space of the engine cover is communicated with an inner space of the silencer so as to define an air passage, and an intake port is formed to the air passage to be communicated with the air passage. The atmospheric air introduced through the intake port flows the air passage of the structure mentioned above towards a throttle body with reduced intake noise.

5 Claims, 5 Drawing Sheets

INTAKE APPARATUS OF OUTBOARD MOTOR

BACKGROUND OF THE INVENTION

The present invention relates to an intake apparatus of an outboard motor having an improved structure for reducing intake noise.

An outboard motor is generally utilized in a relatively clean environment, and accordingly, an air-intake to an engine unit of the outboard motor is performed by directly taking an atmospheric air (merely, air) without using an air cleaner as an intermediate air cleaning means. Therefore, it is necessary to mount a silencer or like means for reducing noise caused at the air-intake time.

In a conventional usual structure of an outboard motor, a silencer is located in a space defined between an outboard motor cover and an engine body along a side portion of the engine body.

However, in recent years, there is an increasing tendency of utilizing a fuel injection type engine for an outboard motor, and in such type of engine, there is adopted a structure in which an intake manifold, a surge tank and the like means are arranged in the space of the side portion of the engine body, and accordingly, there is less space for the location of the silencer. As a result, only a small-sized silencer can be arranged in this space, which results in an inadequate noise silencing or reducing performance.

Furthermore, in an arrangement in which the air-intake port of the silencer is apart from an atmospheric air intake port provided for the outboard motor cover, the atmospheric air taken into the outboard motor cover is heated by a heat of the engine, and when such heated air is guided into the silencer, there may cause a case of reducing an engine output because of increased intake air temperature.

SUMMARY OF THE INVENTION

An object of the present invention is to substantially eliminate defects or drawbacks encountered in the prior art mentioned above and to provide an intake apparatus of an outboard motor capable of arranging a silencer having a large capacity.

Another object of the present invention is to provide an intake apparatus of an outboard motor capable of reducing an intake air temperature.

These and other objects can be achieved according to the present invention by providing an intake apparatus of an outboard motor in which a crank shaft is disposed in an engine unit, the crank shaft has an upper end, in a state of the outboard motor mounted to a hull, which projects outside the engine unit and to which a rotational member is mounted, the rotational member being covered by an engine cover, and the engine unit is covered by an outboard motor cover to which an atmospheric air intake port is formed, wherein the engine cover is composed of inner and outer wall sections between which a closed inner space is defined, the engine cover is connected to a silencer so that the closed inner space of the engine cover is communicated with an inner space of the silencer so as to define an air passage, and an intake port is formed to the air passage to be communicated with the air passage.

In a preferred embodiment, the intake port communicated with the air passage is formed to an upstream side of the air passage at a portion on the side of the atmospheric air intake port.

The closed inner space of the engine cover is arranged substantially horizontally, the silencer is disposed substantially vertically, a downstream end of the engine cover is connected to an upstream end of the silencer so that the air passage provides substantially an L-shape in the connected state of the engine cover and the silencer.

The rotational member may be a flywheel magneto device, the inner wall section of the engine cover has a shape corresponding to an outer shape of the flywheel magneto device and the outer wall section of the engine cover has a shape formed along an inner surface of the outboard motor cover.

The engine cover and the silencer may be connected together through a seal member.

In a more structural manner, the present invention provides an intake apparatus of an outboard motor, comprising an engine cover composed of inner and outer wall sections between which a closed inner space is defined;

an intake port formed to the engine cover at a portion on an atmospheric air intake port side formed to an outboard motor cover;

a silencer disposed downstream side of the engine cover, the engine cover and the silencer being connected so that the closed inner space of the engine cover is communicated with an inner space of the silencer to provide an air passage;

a throttle body connected to a downstream side end of the silencer;

a surge tank connected to a downstream side end of the throttle body; and intake manifold means connected to a downstream side end of the surge tank.

According to the structure of the intake apparatus of an outboard motor of the present invention, the intake apparatus has the air intake port formed to the engine cover composed of the inner and outer wall section in which the inner space is formed, and the silencer has one end connected to the engine cover so that the inner space of the engine cover is communicated with the inside of the silencer as air passage. The atmospheric air taken through the intake port is introduced into the air passage and then guided to a throttle. Thus, the inner volume of the silencer can be increased and, hence, the air intake noise is effectively reduced while passing the air passage.

The inner space of the engine cover is arranged in an installed state horizontally and the silencer is disposed vertically, so that the air passage formed of the inner space of the engine cover and the inside of the silencer has substantially L-shape, which results in the compact structure of the silencer and the outboard motor itself.

The nature and further characteristic features of the present invention will be made clear from the following descriptions made with reference to the accompanying drawings.

DESCRIPTION OF THE PREFERRED EMBODIMENT

One preferred embodiment of an intake apparatus of an outboard motor according to the present invention will be described hereunder with reference to the accompanying drawings.

Figure 1:
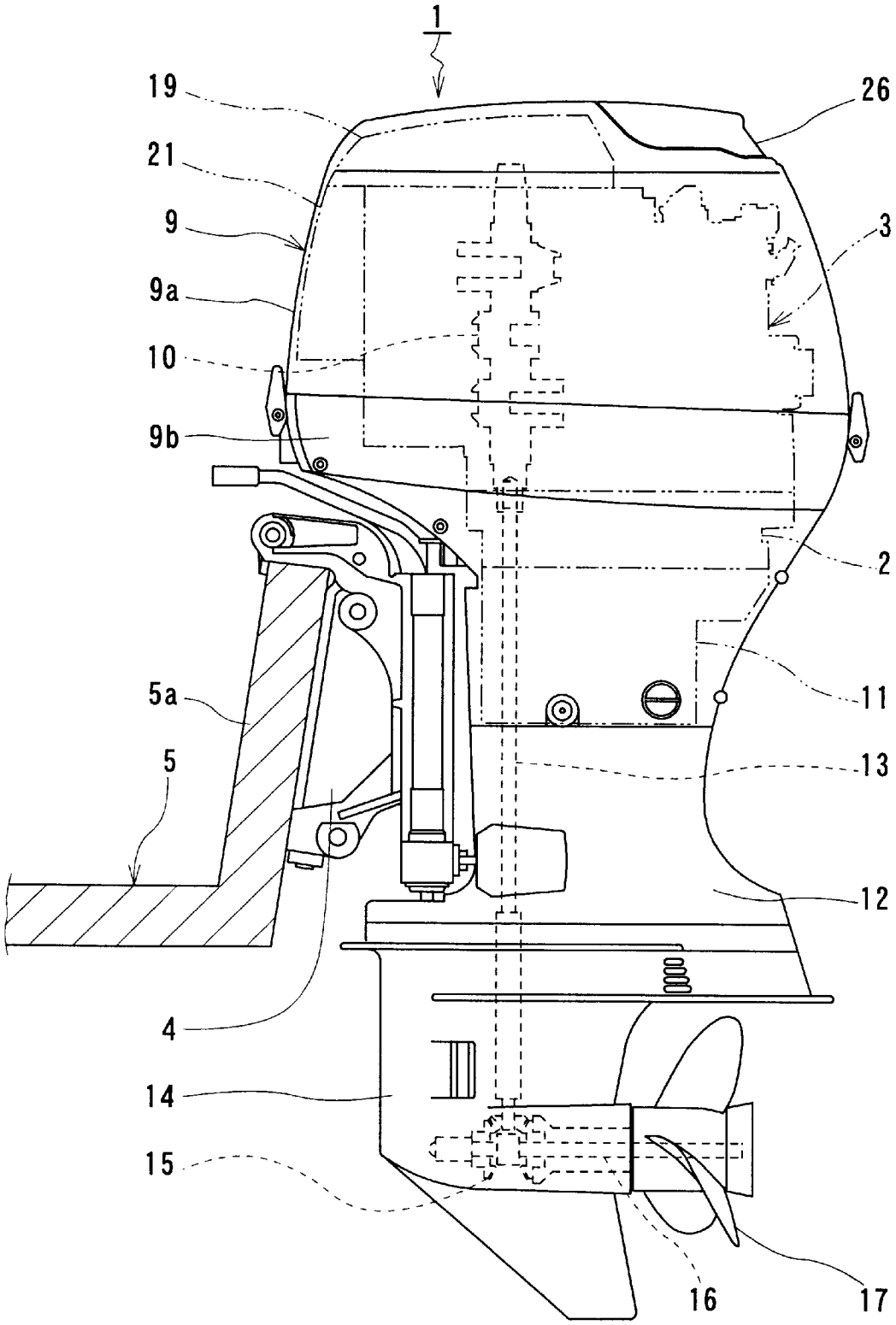
FIG. 1 is a left side view of an outboard motor, in a state mounted to a hull, for example, including one embodiment of an intake apparatus according to the present invention.

Referring to FIG. 1, showing a left side view of an outboard motor which is mounted to a hull 5, for example, and to which the present invention is applied, an outboard motor 1 is provided with an engine holder 2 and an engine or engine unit 3 is mounted to the upper portion of the engine holder 2. A bracket 4 is attached to the engine holder 2 and the outboard motor 1 is mounted to a transom 5*a* of a hull 5 through the bracket 4 in a state shown in FIG. 1.

The engine 3 mounted to the outboard motor 1 is, for example, a water-cooled four-stroke-cycle three-cylinder engine, which is assembled in combination of a cylinder head 6, cylinder block 7, crank case 8, etc. The engine 3 is also covered substantially entirely by an outboard motor cover 9.

Figure 2:
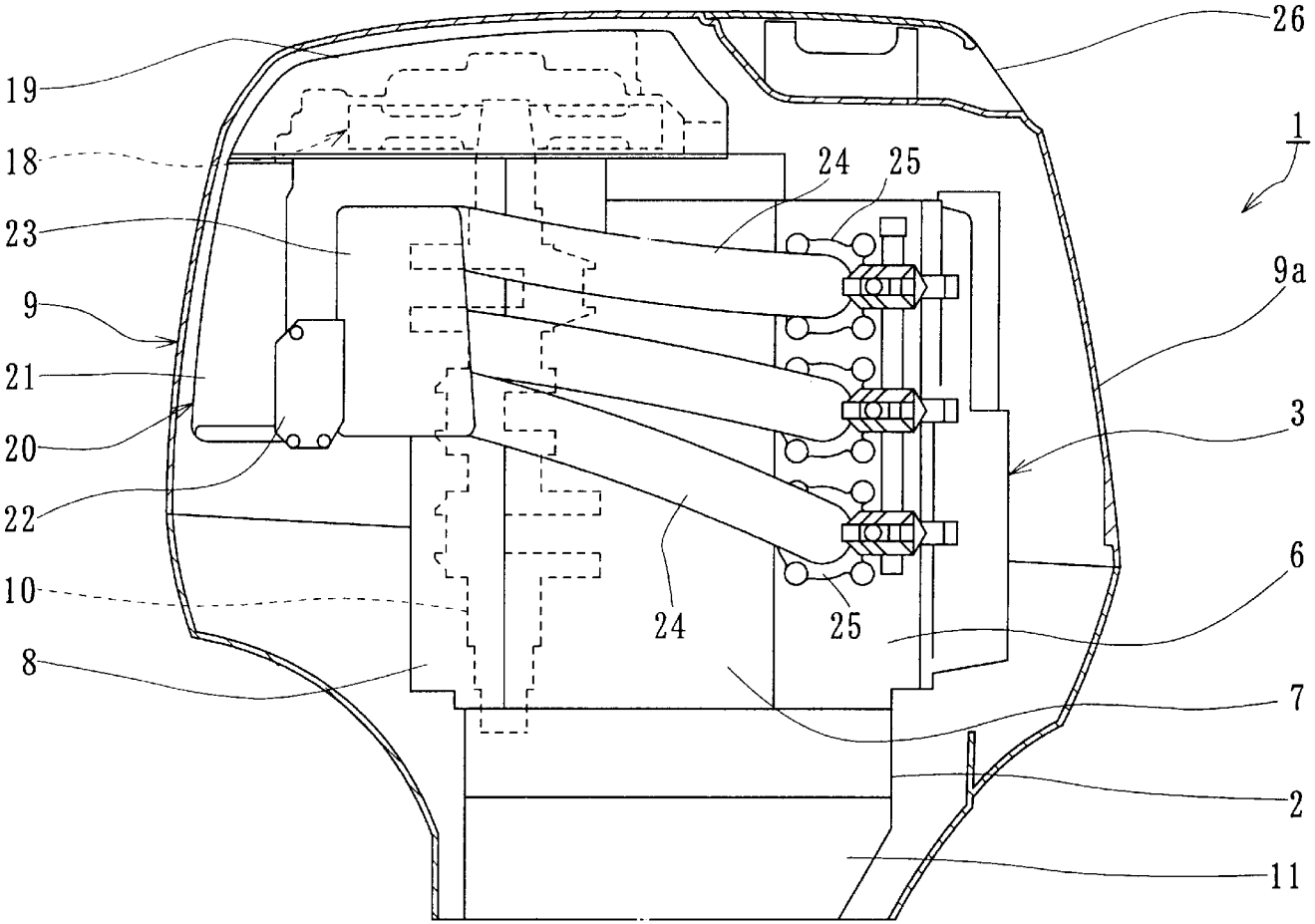
FIG. 2 is a side view of an outboard motor engine in an enlarged scale.

FIG. 2 is an enlarged side view of the engine 3, in which only the outboard motor cover 9 is shown with a cross section. With reference to FIG. 2, the cylinder block 7 is arranged at the rear portion (right side as viewed) of the crank case 8 arranged at the most forward portion of the engine 3 (left side as viewed), and the cylinder head 6 is also arranged at the rear portion of the cylinder block 7. A crank shaft 10 is disposed in the mating portion between the crank case 8 and the cylinder block 7 in a perpendicular attitude as viewed in an installed state, and an oil pan 11 is disposed below the engine holder 2.

As shown in FIG. 1, a drive shaft housing 12 is arranged below the oil pan 11, and a drive shaft 13 is arranged such that the upper end portion of the drive shaft 13 is coupled to the lower end portion of the crank shaft 10 through, for example, spline fitting, so as to extend downward from the crank shaft 10 in the drive shaft housing 12. The drive shaft 13 is operatively connected to a bevel gear 15 and a propeller shaft 16 disposed in a gear case 14 arranged at a lower portion of the drive shaft housing 12 thereby to drive a propeller 17.

The upper end portion of the crank shaft 10 projects over the upper end portion of the engine 3, and a rotating member, for example, flywheel magneto device 18 for power generation, is mounted to the projected portion of the crank shaft 10. The flywheel magneto device 18 is covered by an engine cover 19 from an upper portion thereof so as to protect the same.

An air-intake apparatus (intake apparatus herein) 20 is provided for the engine 3, and the intake apparatus 20 generally includes a silencer 21, a throttle body 22, a surge tank 23 and an intake manifold 24, as shown in FIG. 2, from the left side portion to the engine 3 side in order in this embodiment.

The throttle body 22 is positioned, for example, to an obliquely forward position of the crank case 8 of the engine 3 and the surge tank 23 is disposed to the downward, i.e. rearward, position of the throttle body 22 on the side of the engine 3 in parallel. The intake manifolds 24 extend from the surge tank 23 to the cylinders respectively and then connected to intake ports 25 formed to the cylinder head 6.

The silencer 21 is disposed for the purpose of reducing intake noise and has a vertically extending length having a size capable of being accommodated in the space between the front portion of the engine 3 and the outboard motor cover 9. The rear portion, i.e. downstream side, of the silencer 21 is connected to the upstream side, i.e. front side, of the throttle body 22 as viewed.

Figure 3:
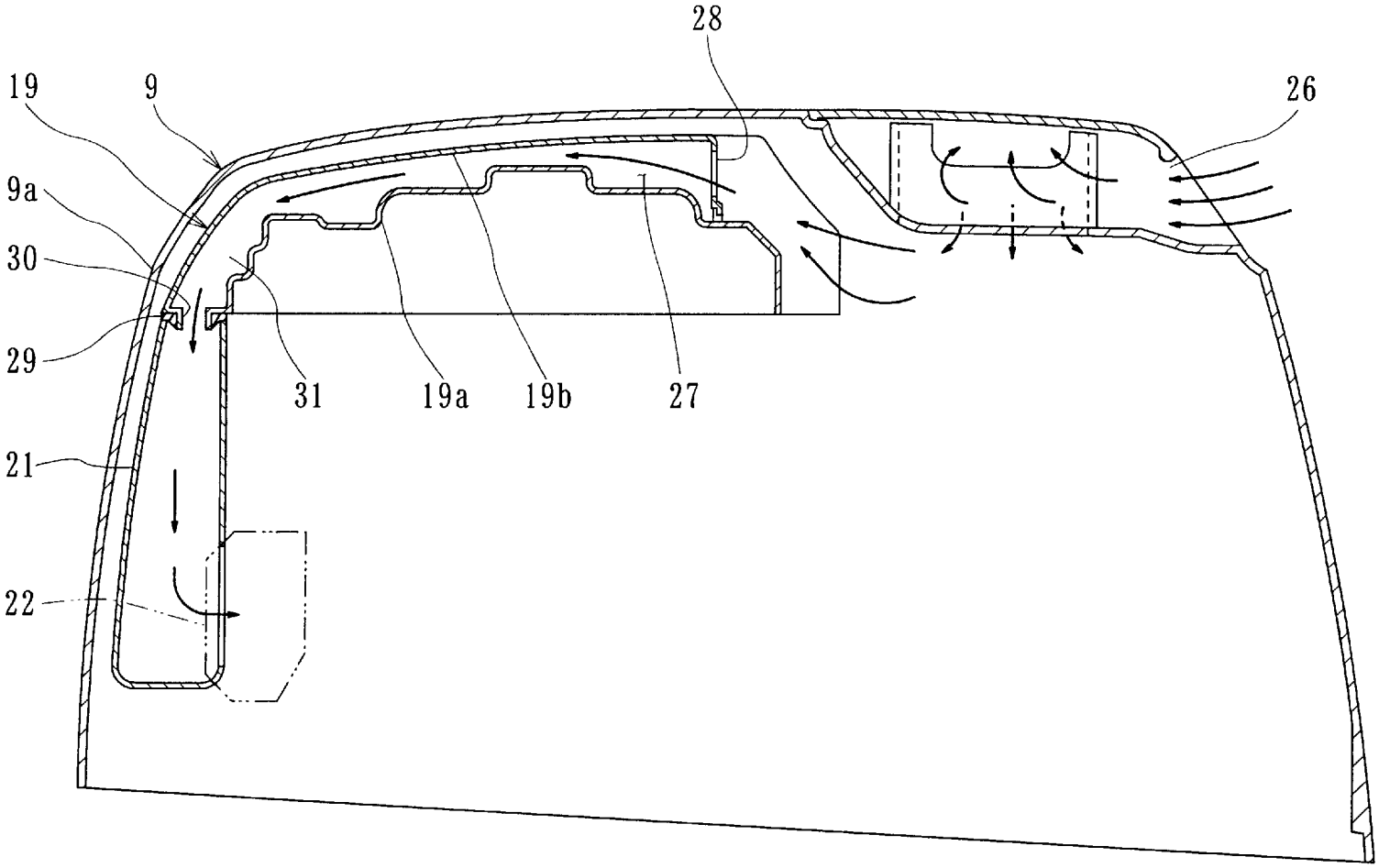
FIG. 3 is an elevational section showing an upper cover section of an outboard motor cover, an engine cover and a silencer.
Figure 4:
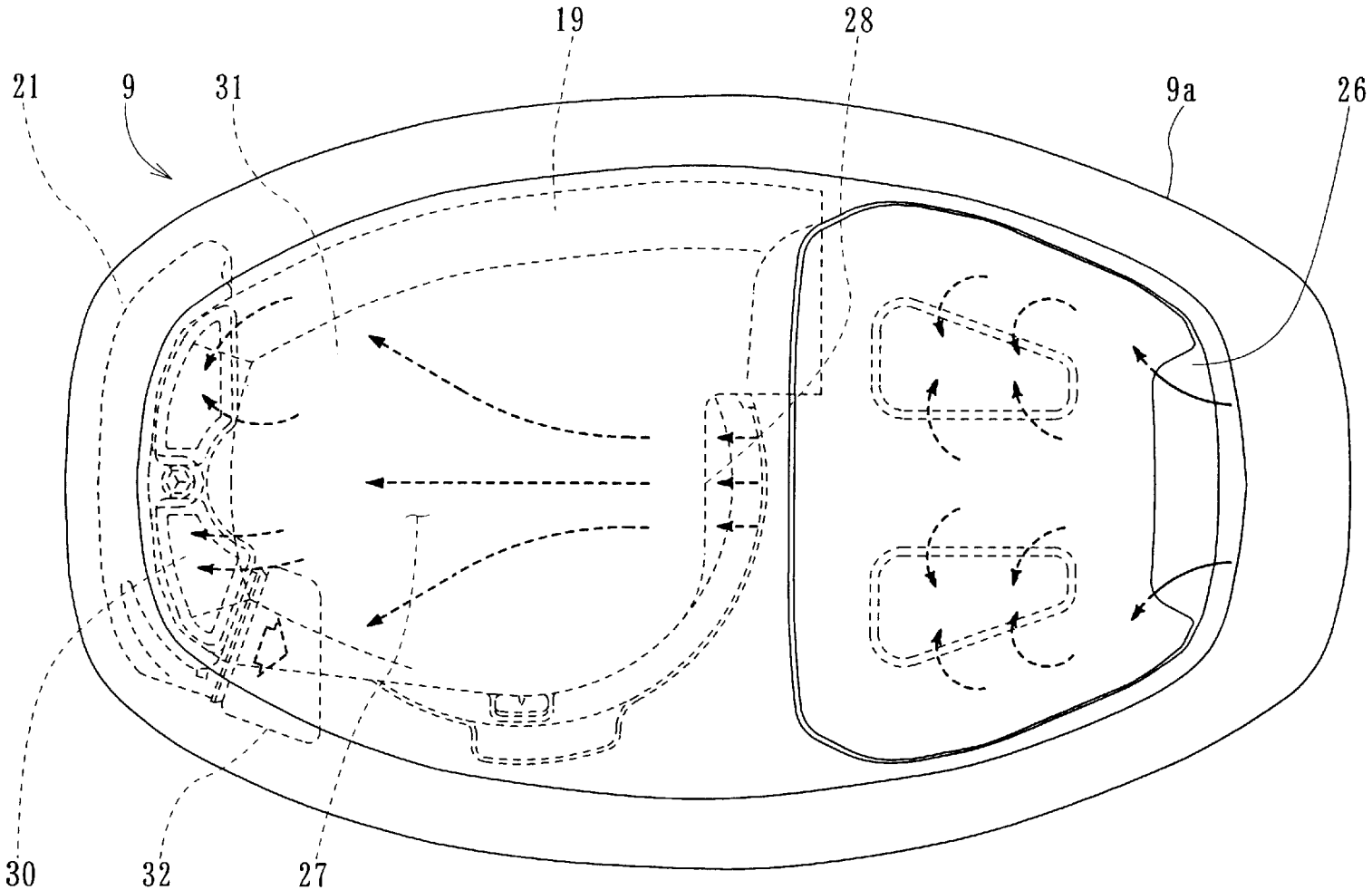
FIG. 4 is a plan view of the upper cover of FIG. 3.
Figure 5:
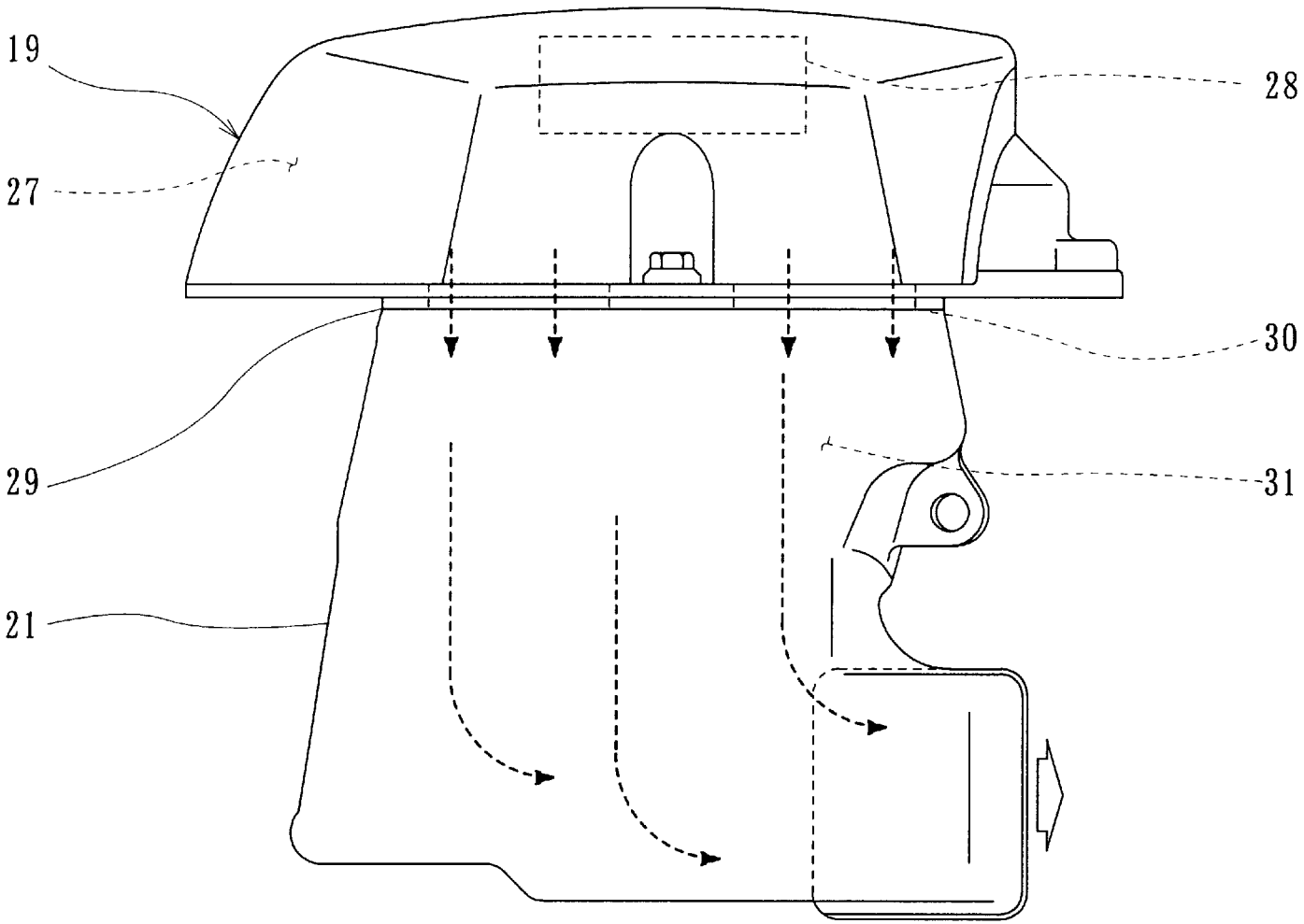
FIG. 5 is a front view showing the engine cover and the silencer of FIG. 3.

With reference to FIGS. 3 to 5, the outboard motor cover 9 is composed of splittable upper cover 9*a* and lower cover 9*b* (FIG. 1), and an atmospheric air intake port 26 for introducing the atmospheric air (merely, air) into the outboard motor cover 9 is formed to the rear upper portion of the upper cover 9*a* as viewed in FIG. 3. The engine cover 19 is disposed inside the outboard motor cover 9 and is composed of an inner wall section formed in shape along an outer shape of the flywheel magneto device 18 and an outer wall section 19*b* formed in shape along an inner shape of the upper cover 9*a,* these inner and outer wall sections 19*a* and 19*b* defining, in combination, an inner closed space 27 therebetween extending horizontally, and an intake port 28 is formed to the engine cover 19 at a portion near the atmospheric air intake port 26 formed to the upper cover 9*a* of the outboard motor cover 9.

A front lower portion, i.e. downstream end, (opposite to the intake port 28 side) of the engine cover 19 is coupled to the upper portion, i.e. upper stream end, of the silencer 21 through a seal member 29 such as rubber to be detachable, and when coupled, the inner space 27 of the engine cover 19 is communicated with the inside of the silencer 21 thereby to provide an approximately L-shaped air passage 31 as viewed in FIG. 3.

The intake apparatus according to the present invention of the structure mentioned above will operate in the following manner.

When the engine 3 is operated, the outer air is introduced into the outboard motor cover 9 through the atmospheric air intake port 26 formed to the rear upper portion of the upper cover section 9*a* of the outboard motor cover 9 and the air is then introduced into the silencer 21 through the intake port 28 formed to the engine cover 19 and the air passage 31 formed therein. The air is thereafter guided to the throttle body 22. Such air flow is shown by arrows in FIG. 3.

According to the present invention, the engine cover 19 covering the rotating member disposed to the upper portion of the engine 3 is formed so as to provide the inner closed space 27, and this inner space 27 is communicated with the inside of the silencer 21 by coupling the engine cover 19 to the silencer 21, thus forming the air passage 31 through which the introduced air is guided to the throttle body 22. According to such structure, the space 27 of the engine cover 19 can be utilized as a portion of the silencer 21. That is, the capacity of the silencer 21 can be increased and, hence, the intake noise can be effectively reduced without making large the size of the silencer itself.

Furthermore, since the atmospheric air intake port 26 is formed to the rear upper portion of the upper cover 9*a* of the outboard motor cover 9 and the intake port 28 of the air passage 31 is disposed near this intake port 26, the air taken into the outboard motor cover 9 is guided to the throttle body 22 through the silencer 21 without almost contacting the heated engine 3, thus reducing the intake temperature and hence improving the output of the engine.

It is to be noted that the present invention is not limited to the described embodiment and many other changes and modifications may be made without departing from the scope of the appended claims.

What is claimed is:

1. An intake apparatus of an outboard motor in which an engine unit is covered by an outboard motor cover to which an air intake port is formed, said intake apparatus comprising:

an engine cover including inner and outer wall sections between which an inner space is defined and said engine cover is connected, at a downstream side portion thereof, to an upstream side end of a silencer disposed downstream of the engine cover so that said inner space of the engine cover is communicated with an inner space of the silencer so as to define an air passage, said air passage having an upstream side end opened as an intake port of the engine cover and a downstream side end communicated with a throttle body disposed downstream of the silencer.

2. An intake apparatus of an outboard motor according to claim 1, wherein said inner space of the engine cover is arranged substantially horizontally, said silencer is disposed substantially vertically, a downstream side end of the engine cover is connected to an upstream side end of the silencer so that said air passage provides substantially an L-shape in the connected state of the engine cover and the silencer.

3. An intake apparatus of an outboard motor according to claim 2, wherein the outboard motor includes a flywheel magneto device, said inner wall section of the engine cover has a shape corresponding to an outer shape of the flywheel magneto device and said outer wall section of the engine cover has a shape formed along an inner surface of an outboard motor cover.

4. An intake apparatus of an outboard motor according to claim 2, wherein said engine cover and said silencer are connected together through a seal member.

5. An intake apparatus of an outboard motor in which an engine unit is covered by an outboard motor cover to which an atmospheric air intake port is formed, said intake apparatus comprising:

an engine cover including inner and outer wall sections between which an inner space is defined;

an intake port formed to the engine cover at a portion on the atmospheric air intake port side;

a silencer disposed downstream side of the engine cover, said engine cover and said silencer being connected so that said inner space of the engine cover is communicated with an inner space of the silencer to provide an air passage;

a throttle body connected to a downstream side end of the silencer;

a surge tank connected to a downstream side end of the throttle body; and intake manifold means connected to a downstream side end of the surge tank.

* * * * *